US006851822B2

(12) United States Patent
Herrera

(10) Patent No.: US 6,851,822 B2
(45) Date of Patent: Feb. 8, 2005

(54) READING AND WRITING ASSISTANT DEVICE

(76) Inventor: Frank T. Herrera, 6607 Ashland Dr., Austin, TX (US) 78723

( * ) Notice: Subject to any disclaimer, the term of this patent is extended or adjusted under 35 U.S.C. 154(b) by 93 days.

(21) Appl. No.: 10/133,298

(22) Filed: Apr. 26, 2002

(65) Prior Publication Data

US 2003/0012013 A1 Jan. 16, 2003

Related U.S. Application Data

(63) Continuation-in-part of application No. 09/903,816, filed on Jul. 11, 2001, now abandoned.

(51) Int. Cl.[7] ..... F21V 33/00

(52) U.S. Cl. ..... 362/99; 362/156; 362/253; 362/802; 281/45

(58) Field of Search ..... 362/98, 99, 156, 362/234, 253, 276, 802; 281/45, 46

(56) References Cited

U.S. PATENT DOCUMENTS

| | | | | |
|---|---|---|---|---|
| 1,202,498 A | * | 10/1916 | Findley | 362/99 |
| 3,364,344 A | * | 1/1968 | Vincent | 362/99 |
| 3,823,312 A | | 7/1974 | Weinstein | 240/64 B |
| 4,290,093 A | * | 9/1981 | Thompson et al. | 362/98 |
| 4,680,681 A | | 7/1987 | Fisherman et al. | 362/98 |
| 6,241,414 B1 | * | 6/2001 | Wien | 281/45 |
| 6,264,029 B1 | | 7/2001 | Motson | 206/320 |

FOREIGN PATENT DOCUMENTS

| | | |
|---|---|---|
| WO | WO 94/12076 | 6/1994 |

* cited by examiner

*Primary Examiner*—Stephen F Husar
(74) *Attorney, Agent, or Firm*—Richard F. Frankeny; Ross Spencer Garsson Winstead Sechrest & Minick P.C.

(57) ABSTRACT

A Reading and Writing Assistant (RW) device has a foldable case for placing reading material in an open and readable position. A retractable light is housed within the case and connected to a battery with sliding contacts. The battery is connected to the sliding contacts with a switch that is OFF when the light is in a stored position and ON when said light is in position to illuminate the reading material. The RW device has a pocket for holding writing material, writing instrument and an electronic dictionary. An option allows the electronic dictionary to be coupled to a slider which attaches to a flexible guide extending from one side of the case to the other parallel to the top edge of the reading material. The electronic dictionary may be moved and placed on the page not being read allowing easy user access. A strap or zipper secures the RW device when closed.

48 Claims, 7 Drawing Sheets

READING AND WRITING ASSISTANT DEVICE

CROSS REFERENCE TO RELATED APPLICATIONS

This application is related to the following commonly owned U.S. patent application:

Application Ser. No. 09/903,816, "Reading and Writing Assistant Device," filed Jul. 11, 2001 now abandoned, of which this Application is a continuation-in-part.

TECHNICAL FIELD

The present invention relates in general to an apparatus for enhancing a reading experience of a user by providing integrated lighting, reading assistance devices and book or magazine protection and storage in one convenient package.

BACKGROUND INFORMATION

Day-timers are small notebook like units in which a user writes notes, telephone numbers, and other information that the user would like to reference. These Day-timers may also contain paper calendars and other useful elements that the user may need when organizing daily schedules. Many times a user may want to take notes when there is no adequate lighting to illuminate the pages of his or her notebook. At other times, a user may want to read a book or magazine without disturbing others by turning on a light that may be distracting. This may happen when the user is in an airplane or possibly while reading in bed. Because the lighting is not always available when the user desires to write a note or read a book or magazine, an individual may not be able to read or to write when in these or similar situations. Moreover, when reading a book or article, a user may come upon words and phrases that are not understood. The user may wish to look up these words in a dictionary to obtain their meanings to better help in understanding the material being read. While pocket electronic dictionaries are available, it is not always convenient to have one ready to use when one is reading a book. Similarly, a dictionary or Thesaurus may be convenient to have when writing.

While notebooks, writing instruments, pocket lights, pads of paper and an electronic dictionary and thesaurus are all available as separate items, a reading and writing assistant that combines all these elements in a synergistic package is not available.

Prior art U.S. Pat. No. 3,364,344 (U.S. Pat. No. 3,364,344) teaches an auxiliary book cover that has a rigid fixed light mounted to the book cover. Battery packs are attached to the outside of the book cover and a switch mechanism is incorporated so that the switch closes when the book covers are opened. U.S. Pat. No. 3,823,312 (U.S. Pat. No. 3,823,312) adds an elongated spine on the book cover in the form of a container for the batteries. Cover leaves are attached to the container and a lamp holder is mounted on one end of the container. A switch mechanism is included with contacts that close and connect the light to the battery when the cover leaves are opened and open and disconnect the battery from the light when the cover leaves are opened. Again, this provides a bulky package that does not necessarily lay flat when opened. The light is rigidly mounted to the assembly and is external to the unit and has little protection. The container designed for the batteries also limits the battery types that can be used.

U.S. Pat. No. 4,680,681 (U.S. Pat. No. 4,680,681) adds to the book covers of U.S. Pat. No. 3,823,312 by utilizing a smaller light and provides a light that is retractable. An elongated container is attached to the spine of the book cover and has two parallel compartments, one for the batteries and one for storing the light in a retractable position. Again, the assembly is rigid and the light and batteries are external to the cover assembly for holding a book or other reading material. While the container for the batteries and the light are protective, they keep the unit from laying flat and keep the batteries and light external to the covers that hold reading material. Foreign Patent No. WO 94/12076 adds pockets and a paper holder to the design disclosed in U.S. Pat. No. 4,680,681. As in the prior art, the light and batteries remain contained in a rigid elongated container incorporated into the spine of the book cover and are still external to the book cover assembly. While the prior art has attempted to provide an integrated package for assisting in reading and writing in a variety of conditions, they have not made a reading assistant device that keeps the light and battery internal to the reading assistant device and provides a unit that lays flat and is easily stored in a brief case.

There is, therefore, a need for a product to assist in reading and writing that is a notebook like structure with features for storing a magazine or a book, electronic dictionaries, reading assistant devices, functional bookmarks, a retractable light and a writing pen or pencil in a way that enhances the reading and writing experience.

SUMMARY OF THE INVENTION

A Reading and Writing Assistant (RW) device includes a retractable, small reading light that is stored internal to the RW device. Batteries and electrical connections for the reading light are also internal to the RW device. The retractable light has automatic ON/OFF switching such that the light is OFF when in the stored position and ON when extracted and in position for use. The RW device may also include a writing pad and a place for putting a pen or pencil.

The retractable reading light is configured so that is it is extendable from within the notebook so the user can position it to a desired position. The battery pack for the retractable light is located within the RW device for easy access by the user. An electronic dictionary has a pocket storage location so that it is convenient and available to the user while reading a book or magazine. The electronic dictionary may also have (or alternately have) a thesaurus function along with other dictionary functions. The electronic dictionary may be sophisticated and include a crossword puzzle dictionary for those users who want to use the RW device while working crossword puzzles. The electronic dictionary has an option that allows it to be attached with a slider to a guide that extends across an inside edge of the RW device. This allows the small electronic dictionary to have a dual function of providing reference for the user as well as operating as a "functional bookmark." Other reading assistant devices may be employed, such as, a planar magnifying Fresnel lens, which may be adapted and used as the functional bookmark. When reading a book or magazine, the functional bookmark (e.g., electronic dictionary) may be best positioned for use by placing it on the page that the user is not viewing. Other functional bookmarks (e.g., Fresnel lens) are positioned on the page being viewed. Without the functionality of the RW device, this would be difficult as it would require the user to constantly move the functional bookmark and hold it in place. With the addition of the flexible guide and the sliding attachment which is coupled to the functional bookmark, the user may simply slide the functional bookmark from one side of the RW device to the other while keeping it on the page of interest. The RW device also has either a zipper or Velcro fastener that allows the RW device to be held closed thereby protecting the light assembly, a book or magazine, functional bookmarks and the other elements wholly within the RW device.

The light assembly containing the retractable reading light and the batteries are wholly contained within the confines of the foldable case making up the body of the RW device. If the RW device is closed the light assembly and the batteries are protected along with other elements of the RW device. In embodiments that use a zipper to secure the foldable case when closed, the light assembly, batteries, and other elements of the RW device may be completely out of view while being protected. Having the light assembly and batteries wholly within the foldable case is more protective and results in a RW device that lays flat when in use and when stored, for example, in a brief case. The batteries are contained in an easily accessible storage area within the foldable case of the RW device and do not have bulky springs and contacts employed in the prior art. The storage area does not totally dictate the size of the batteries so replacement types are easier to obtain.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
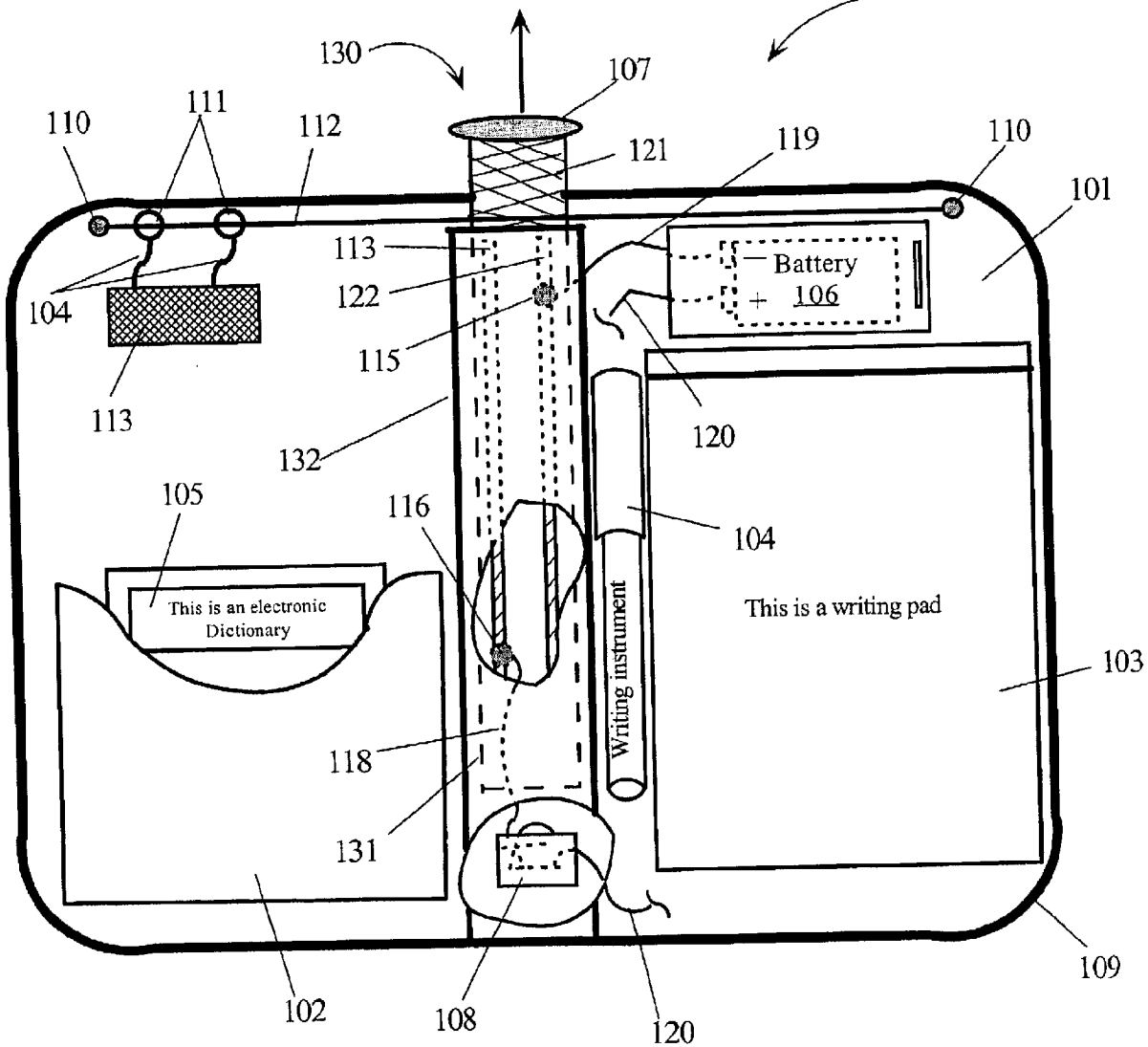
FIG. 1 illustrates elements contained in the RW device.

In the following description, numerous specific details are set forth to provide a thorough understanding of the present invention. However, it will be obvious to those skilled in the art that the present invention may be practiced without such specific details. In other instances, well-known elements have been shown in block diagram form in order not to obscure the present invention in unnecessary detail. For the most part, details concerning manufacturing processes, materials and the like have been omitted in as much as such details are not necessary to obtain a complete understanding of the present invention and are within the skills of persons of ordinary skill in the relevant art.

Refer now to the drawings wherein depicted elements are not necessarily shown to scale and wherein like or similar elements are designated by the same reference numeral through the several views.

FIG. 1 shows RW device 100 in an open position exposing some reading and writing assistant elements. Case 101 houses the elements of the RW device 100. Light assembly 130 comprises a retractable light 107 and is attached to its extension arm 121 and is shown partially extended from the case 101. Case 101 is made as a continuous foldable cover and forms a natural cavity depression 131 which is shown dotted. Light assembly 130 is adapted to attach in cavity 131 and does not create any protrusion on the outside of case 101. Cavity 131 may be covered with a thin piece of semi-rigid material 132 to insure a smooth surface when case 101 is opened. Extension arm 121 is flexible and allows light 107 to be positioned relative to the area of case 101 that contains the elements of RW device 100. Contact rails 113 and 122 are coupled to light 107 and to one terminal of switch 108 with wire 118 and to the negative terminal of battery 106 with wire 119. The positive terminal of battery 106 is connected to wire 120 which connects to the other terminal of switch 108. Switch 108 opens and closes to control current flow to light 107. Extension arm 121 has sliding contacts that electrically mate with contact rails 113 and 122 so the light 107 maintains a current flow when it is moved into and out of case 101.

Light assembly 130 comprises light 107, extension arm 121 and contact rails 113 and 122 and may operate external to RW device 100. However, when it is attached into cavity 131 and electrically connected to battery 106 via a switch mechanism (e.g., 108), it becomes an integral part of RW device 100. Since light assembly 130 is a complete unit, it slips easily into cavity 131 which does not have to have rigid sides. The folded cover making up case 101 has a natural curvature when folded which forms cavity 131 inside of case 101 for light assembly 130. This is an improvement over the prior art, which rigidly attaches an elongated container to book covers to make a housing for batteries and a light external to the book covers. A light assembly 130 useable with embodiments of the present invention is commercially available from Lumatec Industries, Inc., 500 Shady Lane, Austin, Tex. 78702.

Electrical connections to light 107 may be made with sliding contact rails 113 and 122. This allows light 107 to be extended or retracted with extension arm 121 without having to manage a coil of wire. Switch 108 may be configured so that a portion of extension arm 121 makes or breaks contacts in switch 108. Access to battery 106 may also be equipped with a connector (not shown) for coupling a charger (not shown) if RW device 100 contains re-chargeable batteries. Switch 108 may also be configured as an integral part of light assembly 130 by having one of the mating contacts 404 and 405 transition to a non-conducting surface on one of sliding contact rails 113 or 122 when extension arm 121 is retracted to the stored position, thus opening the electrical circuit.

RW device 100 may also have a writing pad 103 which is coupled into a pocket slot (not shown) to secure it inside case 101. A writing instrument 104 is stored in a position close to writing pad 103. Pocket 102 is used to store electronic device 105 when it is not in use. Case 101 may have a zipper 109 that is used for securing the elements of RW device 100 when it is closed. Other methods of securing case 101 in the closed position may be used (e.g., a Velcro strap) and still remain within the scope of the present invention.

RW device 100 is shown with flexible guide 112 which is attached to the inside surface of case 101 with fasteners 110. When case 101 is in the open position, the length of flexible guide 112 causes it to be drawn tight so that it is in tension. Flexible guide 112 is threaded through rings 111 which in turn are coupled to attachment element 113 with flexible cords 104. Attachment element 113 may be moved from one side of case 101 to the other by sliding rings 111 along flexible guide cord 112. Attachment element 113 may have Velcro, flexible magnet material, etc. bonded to its surface. If electronic device 105 has a corresponding mating piece (e.g., a corresponding mating Velcro or flexible magnet material), then it may be coupled to attachment element 113. When electronic device 105 is coupled to attachment element 113, it may be moved across an inside edge of case 101 by sliding rings 111 along guide 112. Flexible cords 104 allow electronic device 105 to be placed in a desired position within case 101. When electronic device 105 is coupled to attachment element 113 it may also be lifted away from the surface of case 101 so that a book 201 (see FIG. 2) or other reading material may be placed in RW device 100. Flexible cords 104 allow electronic device 105 to then be placed on pages of book 201. Other reading assistance devices (e.g., a planar Fresnel lens) may be adapted to attach to element 113. A planar Fresnel lens (not shown) may be used to magnify text to improve visibility for users with poor vision. When the electronic device 105 or reading assistance device is not in use, it may be left on a page as a "functional bookmark". Since RW device 100 is designed to store electronic device 105, its position within RW device 100 does not alter its form when it is left on a page as a book mark.

Figure 2:
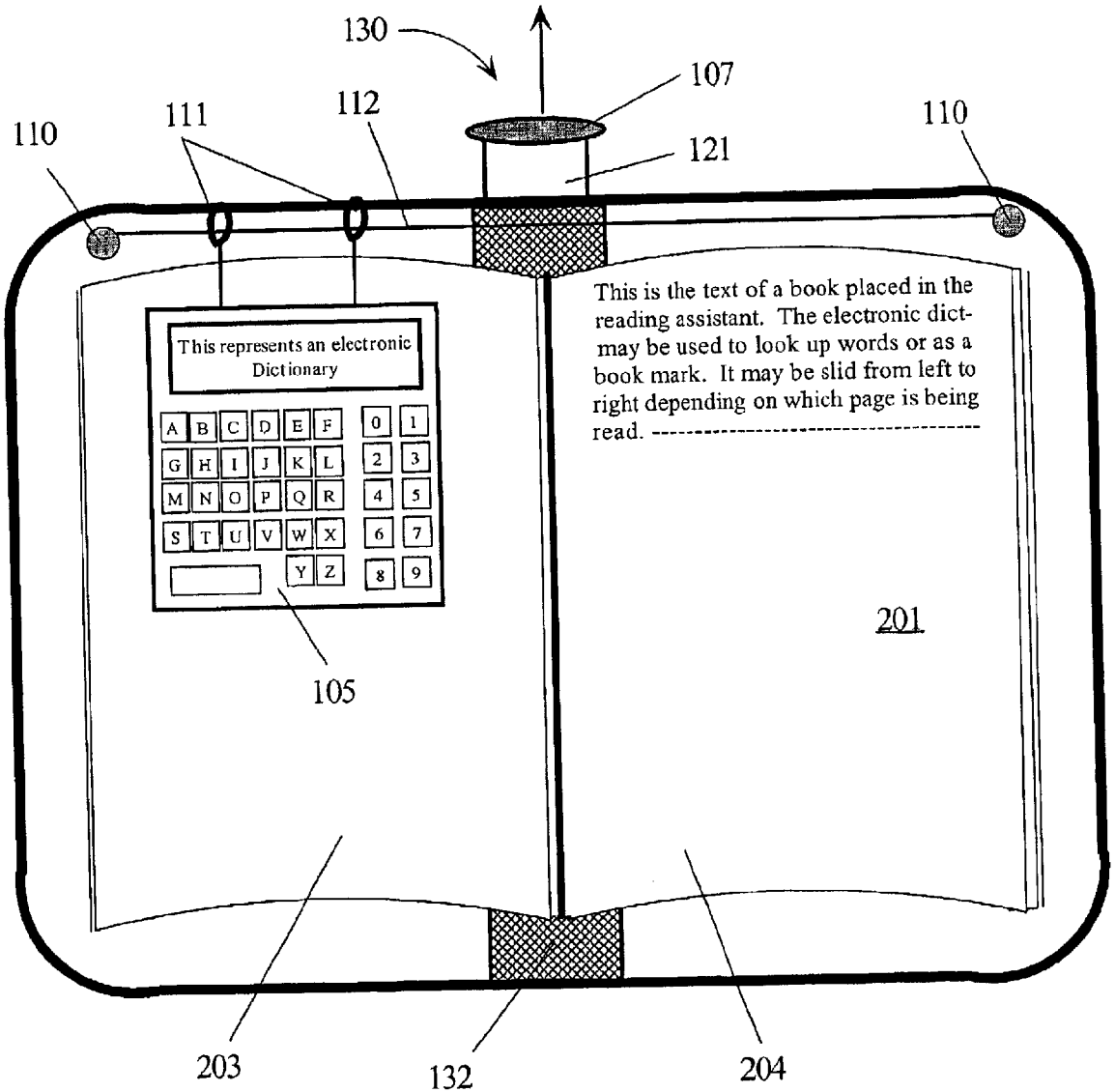
FIG. 2 is a view of the RW device with a book in place along with an electronic dictionary coupled to the flexible guide cord with a slider.

FIG. 2 shows a book 201 positioned within RW device 100 and an electronic device (electronic dictionary) 105. Retractable light 107 is also shown extending from the case 101. Rings 111, which are attached to flexible guide cord 112, are shown coupled with attachment element 113 to electronic device 105 and allow the reader to place the electronic device 105 on the page of book 201 that a user is not reading. In this position, the electronic device 105 is available for use and does not interfer with the text on page 204 on the right side. When the reader turns the page of book 201, electronic device 105 may be lifted away from page 203 and then slid across and placed on the next right page 204 where it will not interfere with text on the next left page 203. Other reading assistance devices (e.g., a Fresnel lens) may be placed on a page that is being viewed while being used as a "functional bookmark."

Figure 3:
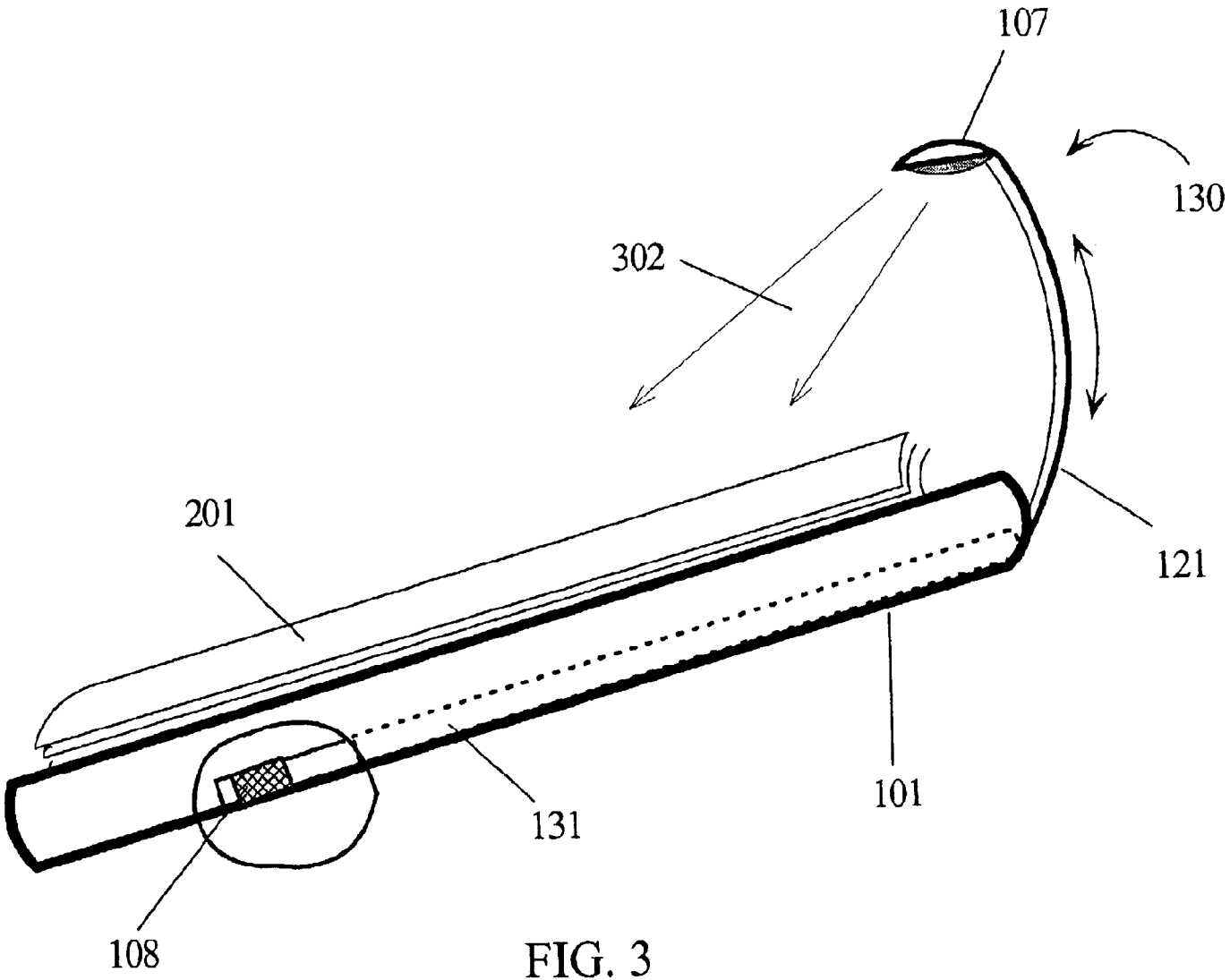
FIG. 3 is a side view of the RW device showing the reading light extended from its storage location to enhance reading of a book.

FIG. 3 is a side view of RW device 100 showing light 107 fully extended by extension arm 121 and shining light 302 on book 201. Cavity 131 is shown internal to case 101 and is used to store light 107 when it is retracted. In the embodiment in FIG. 3, switch 108 makes contact to a portion of extension arm 121 when it is in the fully retracted position such that switch 108 disconnects battery 106 from the electrical circuit of light 107.

Figure 4A:
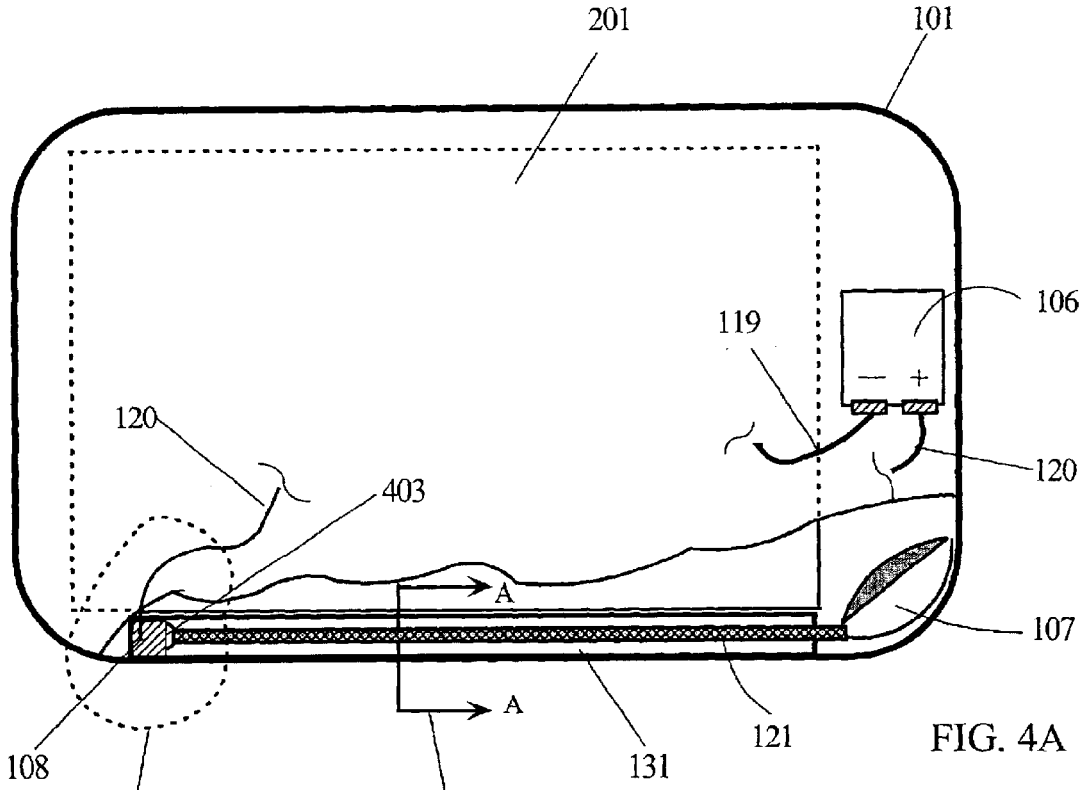
FIG. 4A is a side view of the RW device in the close position illustrating details of the electrical contact and circuits for coupling the extendable light to the battery.
Figure 4B:
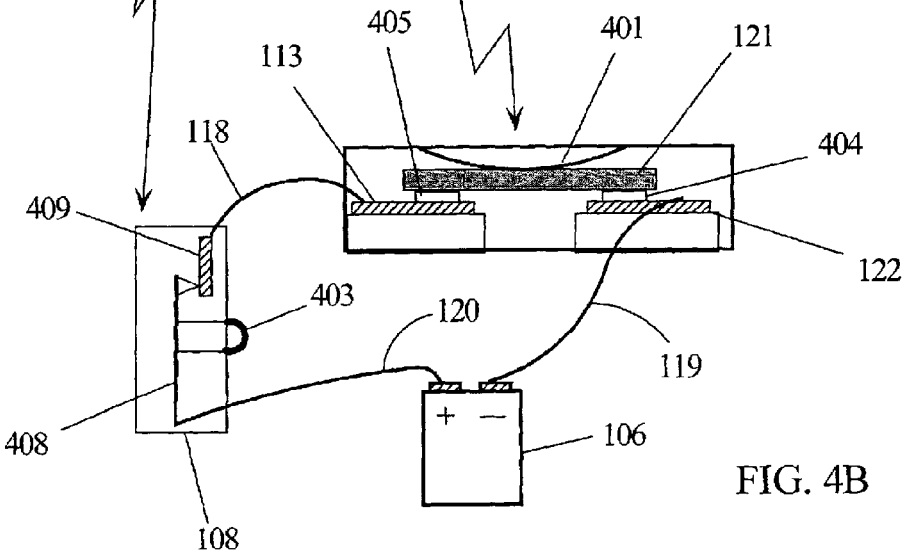
FIG. 4B is an expanded view of a switch and circuitry used for the RW device.

FIGS. 4A and 4B are section views of RW device 100 illustrating more details of the circuitry which may be used for operation of light 107. In FIG. 4A, case 101 is shown enclosing book 201. Battery 106 has connecting wires 119 and 120. Wire 120 connects to switch 108 (see FIG. 4B) and wire 119 connects to one of contact rails 113 (see FIG. 1). Light 107 and extension arm 121 are shown fully retracted such that a portion of extension arm 121 contacts button 403 on switch 108. Button 403 is mechanically coupled to switch element 408 (see FIG. 4B) such that it operates to open the electrical connection of contacts 408 and 409 when extension arm 121 is in the fully retracted position. In other embodiments of the present invention, battery 106 may be connected to the electrical circuit of light 107 with a connector (not shown) enabling light assembly 130 to be removed from RW device 100.

FIG. 4B shows additional detail of the electrical circuit for light 107. Switch 108 and section view A—A are shown expanded in FIG. 4B. Contact 408 of switch 108 is connected to the positive terminal of battery 106 with wire 120 and contact 409 is connected to contact rail 113 (connection 116, see FIG. 1). Extension arm 121 has contacts 404 and 405 which are connected to corresponding terminals on the electrical circuit of light 107. Spring 401 presses extension arm 121 to contact rails 113 and 122 to insure good electrical connection when extension arm 121 is being extended. The negative terminal of battery 106 is connected to contact rail 122 (contact 115, see FIG. 1) with wire 119. When light 107 is fully retracted, a portion of extension arm 121 engages button 403 on switch 108 and opens contacts 408 and 409 turning light 107 OFF. As light 107 is being extended, contacts 408 and 409 close and light 107 turns ON. While light 107 is being fully extended, contacts 404 and 405 make continuous sliding electrical connection to contact rails 113 and 122. In an alternate embodiment, one of contacts 404 and 405 slides off its corresponding contact rail 113 or 122 to turn light 107 off.

Figure 5:
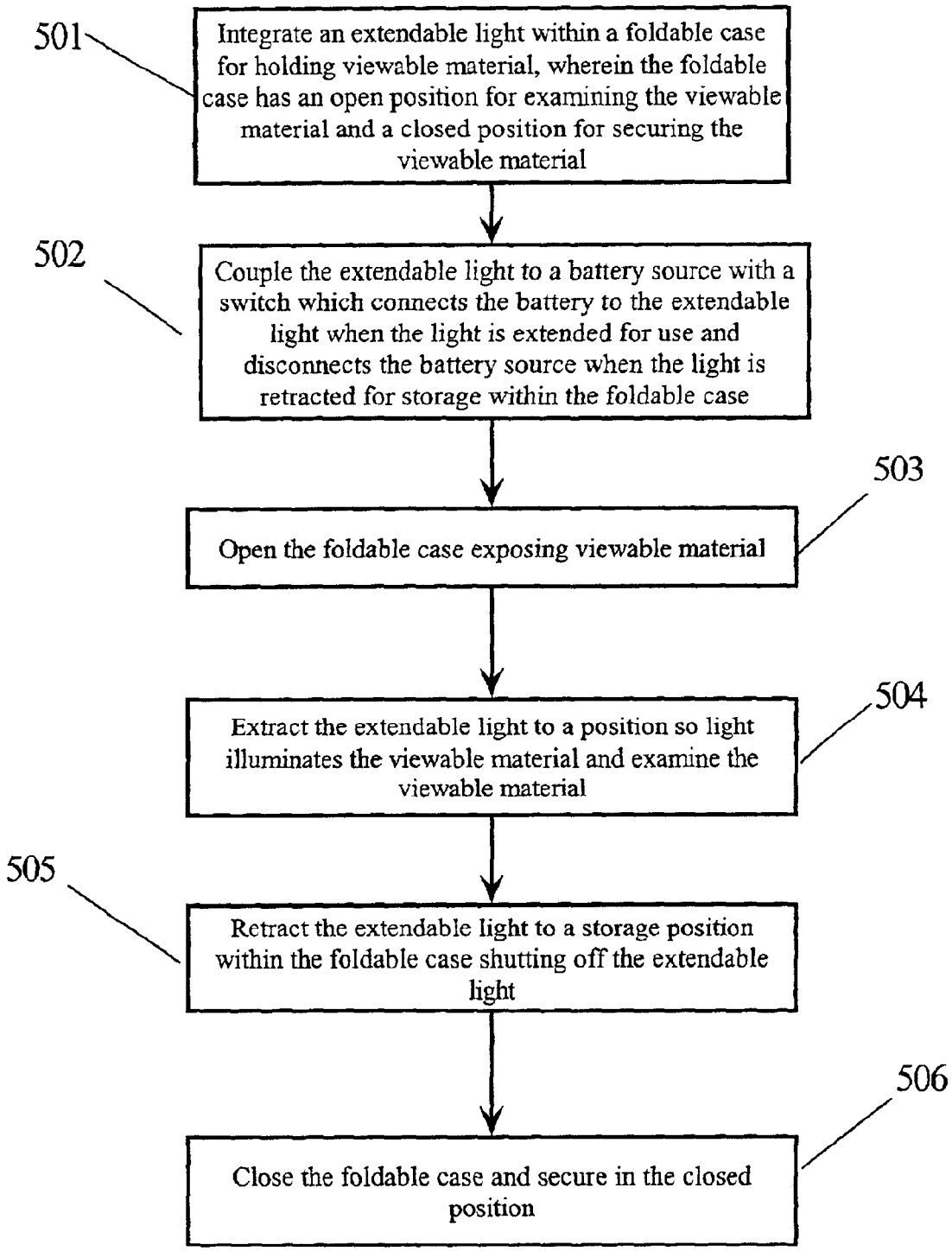
FIG. 5 is a flow diagram of method steps used in embodiments of the present invention.

FIG. 5 is a flow diagram of method steps in one embodiment of the present invention. In step 501, an extendable light 107 is integrated within a foldable case 101 which has an open position for examining viewable material and a close position for securing the viewable material. In step 502, extendable light 107 is coupled to a battery source 106 with a switch that electrically connects the battery to extendable light 107 when it is extended and disconnects battery source 106 when extendable light 107 is retracted within foldable case 101. In step 503, foldable case 101 is opened exposing viewable material (e.g., book 201). In step 504, extendable light 107 is extended to a position where switch 108 connects battery source 106 and turns it on and light 302 illuminates book 201 so that it may be read. In step 505, light 107 is retracted to a storage position within case 101 where switch 108 disconnects battery source 106 turning it off. In step 506, foldable case 101 is closed and secured with a securing mechanism (e.g., zipper 109).

Figure 6:
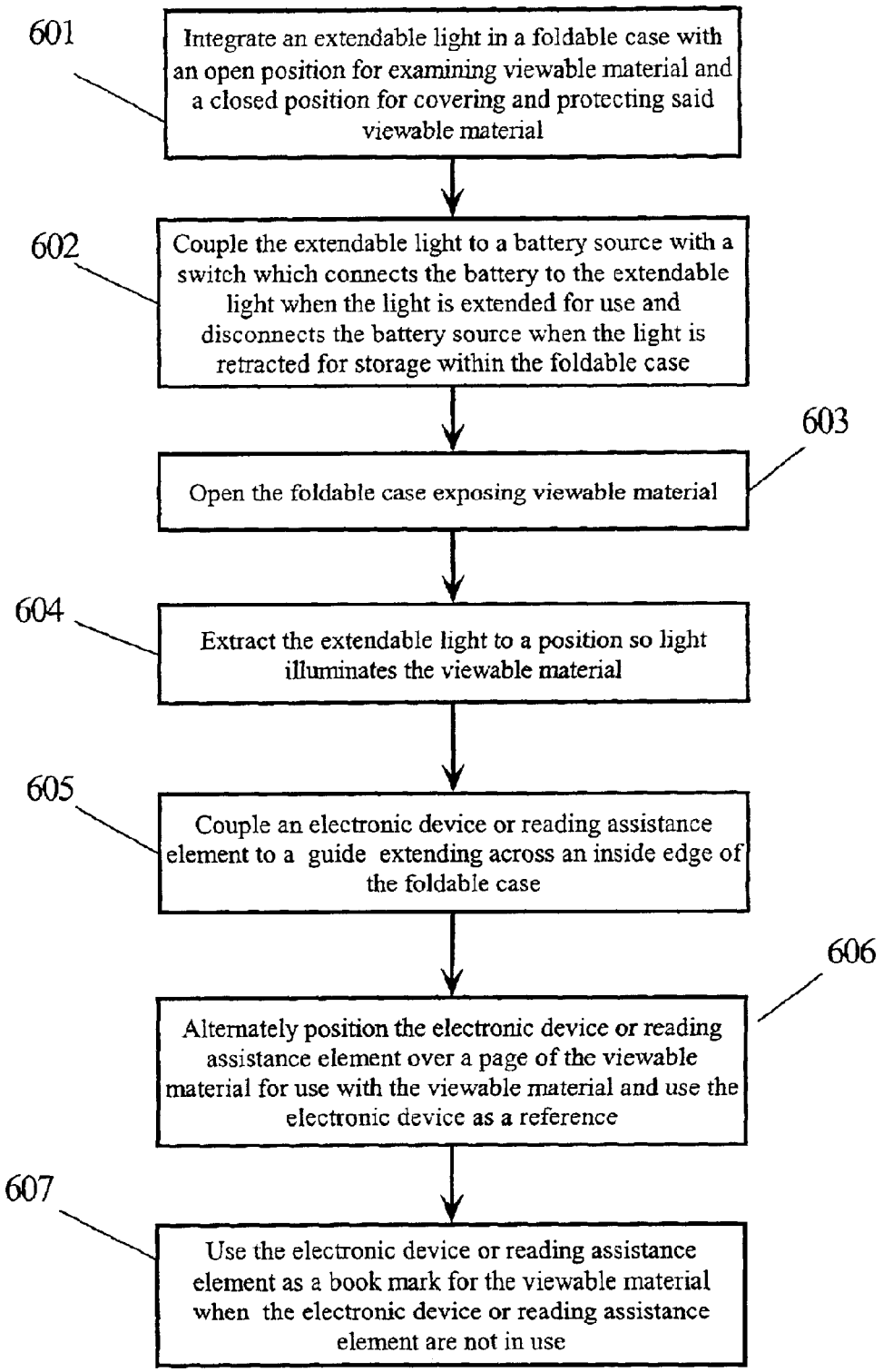
FIG. 6 is a flow diagram of method steps used in embodiments of the present invention.

FIG. 6 is a flow diagram of method steps in another embodiment of the present invention. In step 601, an extendable light 107 is integrated within a foldable case 101 which has an open position for examining viewable material and a close position for securing the viewable material. In step 602, extendable light 107 is coupled to a battery source 106 with a switch that electrically connects the battery to extendable light 107 when it is extended and disconnects battery source 106 when extendable light 107 is retracted within foldable case 101. In step 603, foldable case 101 is opened exposing viewable material (e.g., book 201). In step 604, extendable light 107 is extended to a position where switch 108 connects battery source 106 and turns it on and light 302 illuminates book 201 so that it may be read. In step 605, an electronic device 105 or reading assistant element is coupled to a flexible guide cord 112 with attachment 113 and cords 104. In step 606, electronic device 105 or reading assistant element is alternately positioned over pages of book 201 not being viewed (or being viewed) so that it is in place for use. If electronic device 105 is a dictionary, it may be used to look up words or phrases while reading book 201. In step 607, electronic device 105 is left positioned on a page as a functional bookmark to hold a readers place in book 201 when foldable case 101 is closed.

Figure 7A:
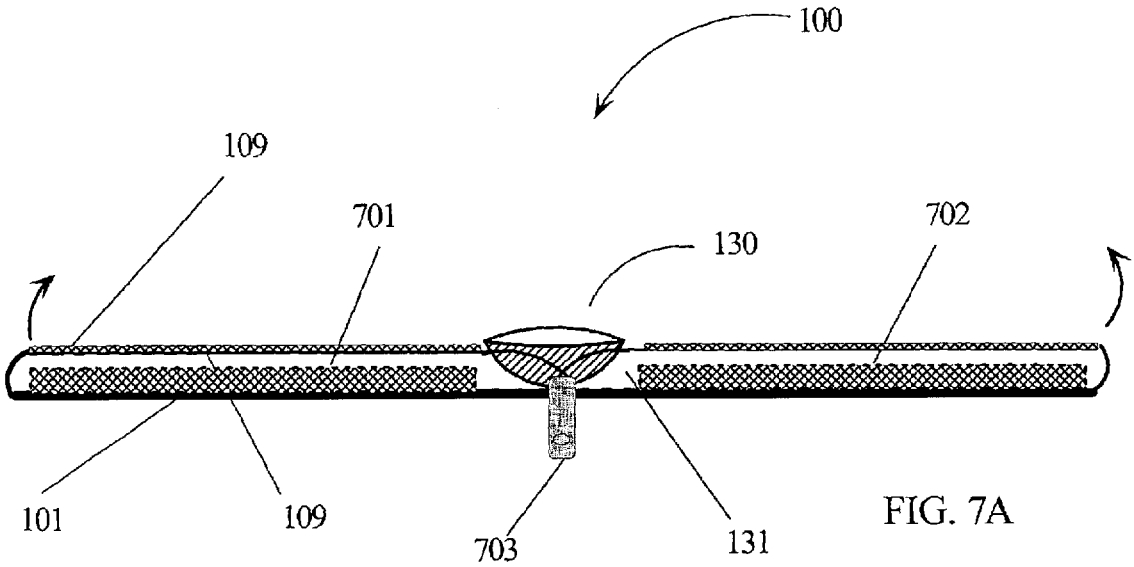
FIG. 7A and FIG. 7B illustrate one embodiment of the present invention illustrating the light assembly incorporated wholly inside the RW device.
Figure 7B:
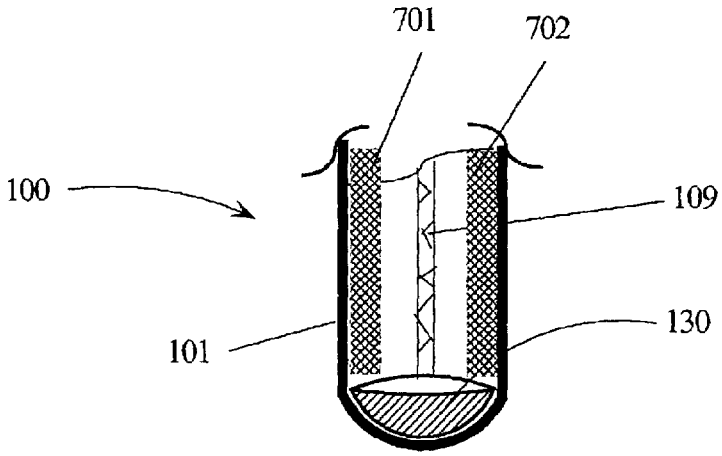

FIG. 7A and FIG. 7B illustrate one embodiment of the present invention illustrating the light assembly 130 incorporated wholly inside RW device 100. In FIG. 7A, foldable case 101 with exemplary zipper 109 is shown open and substantially flat. An exemplary zipper tab 703 is also shown. The material holding zipper 109 is shown clear so that cavity 131 is observable. Cavity 131 is naturally formed by structures 701 and 702 that make up the storage (e.g., pockets) for holding elements of RW device 100 (e.g., electronic device, pad, pen, etc.). Self-contained light assembly 130 may be secured in cavity 131 by straps or other means without resorting to a container as is done in the prior art. In the embodiment of FIGS. 7A and 7B, light assembly 130 resides wholly within foldable case 101 and would be out of view if zipper 109 is zippered closed. FIG. 7B illustrates how foldable case 101 conforms to light assembly 130 during closing and securing RW device 100. When RW device 100 is open or closed, the outside surface is smooth without protrusions and all the elements of RW device 100 are securely held within the cover of foldable case 101. Foldable case 101 has two surfaces when opened. The inside surface that contains storage for the writing pad, battery, functional bookmark, etc. and the outside surface. When the foldable case is closed the inside surface forms a "inside space" for the elements and the outside surface provides the protection surface. The light assembly 130 is wholly within this inside space when the foldable case is closed. This is differentiated from a container for the light and battery that is coupled to the outside surface as is done in the prior art.

In one embodiment of the present invention, battery 106 has a rectangular area and a thickness of a note pad. In this embodiment, battery 106 slips into a pocket like a paper pad and is adaptable to connect to light 107 or to an auxiliary connector (not shown) for use with one of the functional bookmark devices (e.g., electronic dictionary, PDA, etc.). Battery 106 may be further adapted to be recharged with a compatible charger by using the same auxiliary connector (not shown). Battery 106 may be configured with a cable that allows it to be plugged into light assembly 130 such that both battery 106 and light assembly 130 may be removed from RW device 100 for off-line use. A battery 106 for use in this embodiment is commercially available from PEP, Inc., 940 Disc Drive, Scotts Valley, Calif. 95066.

Although the present invention and its advantages have been described in detail, it should be understood that various changes, substitutions and alterations can be made herein without departing from the spirit and scope of the invention as defined by the appended claims.

What is claimed is:

1. A device for assisting in reading and writing comprising:

(a) a foldable case for housing viewable material, said foldable case having an open position for viewing said viewable material and a closed position wherein an inside space is formed for holding and securing said viewable material within said foldable case;

(b) a light assembly coupled within said inside space of said foldable case, said light assembly having a light coupled to an extension arm for placing and holding said light in a first position to illuminate said viewable material when said foldable case is in said open position and retracting said light to a second position within said inside space of said foldable case for storing;

(c) a mechanism for securing said foldable case in said closed position thereby holding and protecting any elements housed in said inside space; and (d) a battery housed within said inside space of said foldable case and electrically connected to said light when said light is in said first position and electrically disconnected from said light when said light is in said second position.

2. The device of claim 1, wherein said battery is electrically connected and disconnected from said light in response to positions of said extension arm.

3. The device of claim 1, wherein said battery is housed in a pocket within said inside space of said foldable case and said battery is adaptable to power selected ones of said functional bookmarks or other electronic devices.

4. The device of claim 1 further comprising a functional bookmark having a first function when examining said viewable material and a bookmark function when said functional bookmark is not in use when examining said viewable material.

5. The device of claim 1 wherein said foldable case must be opened before said light is positioned by said extension arm into said first position.

6. The device of claim 1 further comprising a writing pad and a writing instrument coupled within said inside space of said foldable case.

7. A device for assisting in reading and writing comprising:

(a) a foldable case for housing viewable material, said foldable case having an open position for viewing said viewable material and a closed position wherein an inside space is formed for holding and securing said viewable material within said foldable case;

(b) a light assembly coupled within said inside space of said foldable case, said light assembly having a light coupled to an extension arm for placing and holding said light in a first position to illuminate said viewable material when said foldable case is in said open position and retracting said light to a second position within said inside space of said foldable case for storing;

(c) a mechanism for securing said foldable case in said closed position thereby holding and protecting any elements housed in said inside space; and (d) a functional bookmark having a first function when examining said viewable material and a bookmark function when said functional bookmark is not in use when examining said viewable material.

8. The device of claim 7 further comprising a battery housed within said inside space of said foldable case and electrically connected to said light when said light is in said first position and electrically disconnected from said light when said light is in said second position.

9. The device of claim 7 further comprising a pocket coupled on an inside surface of said foldable case for holding said functional bookmark.

10. The device of claim 7 further comprising a guide element that extends across an inside edge of said foldable case when said foldable case is in said open position and folds within said inside space of said foldable case.

11. The device of claim 10 further comprising a slider coupled to said guide element, said slider attachable to said functional bookmark so said functional bookmark is moveable across said inside edge of said foldable case when in said open position while being held in a predetermined position relative to said inside edge of said foldable case.

12. The device of claim 7, wherein said functional bookmark is selected from the group consisting of:

an electronic dictionary, an electronic cross-word puzzle dictionary, a voice recorder, a personal digital assistant (PDA), an electronic calculator, an electronic Thesaurus, and a Fresnel lens.

13. The device of claim 11, wherein said functional bookmark is placed on a first portion of said viewable material for use while viewing a second portion of said viewable material.

14. The device of claim 11, wherein said functional bookmark is placed on a first portion of said viewable material and used with said first portion of said viewable material.

15. The device of claim 11, wherein said functional bookmark is positioned and held by said slider to bookmark pages of said viewable material when said functional bookmark is not in use with said viewable material.

16. The device of claim 11, wherein said functional bookmark is selected from the group consisting of:

an electronic dictionary, an electronic cross-word puzzle dictionary, a voice recorder, a personal digital assistant (PDA), an electronic calculator, an electronic Thesaurus, and a planar Fresnel lens.

17. A device for assisting in reading and writing comprising:

(a) a foldable case for housing viewable material, said foldable case having an open position for viewing said viewable material and a closed position wherein an inside space is formed for holding and securing said viewable material within said foldable case;

(b) a light assembly coupled within said inside space of said foldable case, said light assembly having a light coupled to an extension arm for placing and holding said light in a first position to illuminate said viewable material when said foldable case is in said open position and retracting said light to a second position within said inside space of said foldable case for storing; and (c) a mechanism for securing said foldable case in said closed position thereby holding and protecting any elements housed in said inside space, wherein said foldable case must be opened before said light is positioned by said extension arm into said first position.

18. A device for assisting in reading and writing comprising:

(a) a foldable case for housing viewable material, said foldable case having an open position for viewing said viewable material and a closed position wherein an inside space is formed for holding and securing said viewable material within said foldable case;

(b) a light assembly coupled within said inside space of said foldable case, said light assembly having a light coupled to an extension arm for placing and holding said light in a first position to illuminate said viewable material when said foldable case is in said open position and retracting said light to a second position within said inside space of said foldable case for storing;

(c) a mechanism for securing said foldable case in said closed position thereby holding and protecting any elements housed in said inside space; and (d) a writing pad and a writing instrument coupled within said inside space of said foldable case.

19. A method for assisting in using viewable material comprising the steps of:

(a) providing a foldable case for holding said viewable material, said foldable case having an open position for viewing said viewable material and a closed position wherein an inside space is formed for holding and securing said viewable material within said foldable case;

(b) integrating a light assembly within said inside space of said foldable case, said light assembly having a light coupled to an extension arm for placing and holding said light in a first position to illuminate said viewable material when said foldable case is in said open position and retracting said light to a second position within said inside space of said foldable case for storing;

(c) electrically connecting said light to a battery with a switch element when said light is in said first position; and (d) electrically disconnecting said battery from said light with said switch element when said light is in said second position.

20. The method of claim 19 further comprising the step of using a functional bookmark having a first function when used in examining said viewable material and having a bookmark function when said functional bookmark is not in use while examining said viewable material.

21. The method of claim 20 further comprising the step of storing said functional bookmark in a pocket within said inside space of said foldable case.

22. The method of claim 20 further comprising the steps of:

(a) coupling a slider to a guide element that extends across an inside edge of said foldable case when open, said slider moveable along said guide element;

(b) attaching said functional bookmark to said slider;

(c) moving said functional bookmark along said guide element with said slider;

(d) placing and holding said functional bookmark on pages of said viewable material for use while examining said viewable material; and (e) using said functional bookmark as a bookmark on pages of said viewable material when said functional bookmark is not in use examining said viewable material.

23. The method of claim 19 further comprising the steps of:

(a) storing said battery within said inside space of said foldable case, said battery adaptable for use with selected ones of said functional bookmarks or other electronic devices;

(b) storing a writing instrument and writing pad in said foldable case; and (c) securing said foldable case in said closed position protecting any elements housed in said inside space.

24. The method of claim 19, wherein said switch element connects and disconnects said battery from said light in response to physical positions of said extension arm.

25. The method of claim 20, said functional bookmark is selected from the group consisting of:

an electronic dictionary, an electronic cross-word puzzle dictionary, an electronic calculator, a voice recorder, a personal digital assistant (PDA), an electronic Thesaurus, and a Fresnel lens.

26. The method of claim 22, wherein said functional bookmark is selected from the group consisting of:

an electronic dictionary, an electronic cross-word puzzle dictionary, an electronic calculator, a voice recorder, a personal digital assistant (PDA), an electronic Thesaurus, and a Fresnel lens.

27. The method of claim 19, wherein said foldable case must be open before said light is positioned by said extension arm in said first position.

28. A device for assisting in reading and writing comprising:

(a) a foldable case for housing viewable material, said foldable case having an open position for viewing said viewable material and a closed position wherein an inside space is formed for holding and securing said viewable material within said foldable case;

(b) a light assembly coupled to said foldable case, said light assembly having a light coupled to an extension arm for placing and holding said light in a first position to illuminate said viewable material when said foldable case is in said open position and retracting said light to a second position within said inside space of said foldable case for storing;

(c) a battery housed within said inside space of said foldable case and electrically connected to said light when said light is in said first position and electrically disconnected from said light when said light is in said second position; and (d) a mechanism for securing said foldable case in said closed position thereby holding and protecting any elements housed in said inside space.

29. The device of claim 28 further comprising a functional bookmark having a first function when examining said viewable material and a bookmark function when said functional bookmark is not in use examining said viewable material.

30. The device of claim 28, wherein said battery is electrically connected and disconnected from said light in response to positions of said extension arm.

31. The device of claim 28 further comprising a writing pad and a writing instrument coupled within said inside space of said foldable case.

32. The device of claim 29, wherein said battery is adaptable to power selected ones of said functional bookmarks or other electronic devices.

33. The device of claim 29 further comprising a pocket within said inside space of said foldable case for holding said functional bookmark.

34. The device of claim 29 further comprising a guide element that extends across an inside edge of said foldable case when said foldable case is in said open position and folds within said inside space of said foldable case.

35. The device of claim 34 further comprising a slider coupled to said guide element, said slider attachable to said functional bookmark so said functional bookmark is moveable across said inside edge of said foldable case when in said open position while being held in a predetermined position relative to said inside edge of said foldable case.

36. The device of claim 29, wherein said functional bookmark is selected from the group consisting of:

an electronic dictionary, an electronic cross-word puzzle dictionary, a voice recorder, a personal digital assistant (PDA), an electronic calculator, an electronic Thesaurus, and a Fresnel lens.

37. The device of claim 35, wherein said functional bookmark is placed on one portion of said viewable material for use while viewing another portion of said viewable material.

38. The device of claim 35, wherein said functional bookmark is placed on a first portion of said viewable material for use while viewing a second portion of said viewable material.

39. The device of claim 35, wherein said functional bookmark is placed on a first portion of said viewable material and used with said first portion of said viewable material.

40. The device of claim 35, wherein said functional bookmark is selected from the group consisting of:

an electronic dictionary, an electronic cross-word puzzle dictionary, a voice recorder, a personal digital assistant (PDA), an electronic calculator, an electronic Thesaurus, and a Fresnel lens.

41. A device for assisting in reading and writing comprising:

(a) a foldable case for housing viewable material, said foldable case having an open position for viewing said viewable material and a closed position wherein an inside space is formed for holding and securing said viewable material within said foldable case;

(b) a light assembly coupled to said foldable case, said light assembly having a light coupled to an extension arm for placing and holding said light in a first position to illuminate said viewable material when said foldable case is in said open position and retracting said light to a second position within said inside space of said foldable case for storing;

(c) a functional bookmark having a first function when examining said viewable material and a bookmark function when said functional bookmark is not in use examining said viewable material; and (d) a mechanism for securing said foldable case in said closed position thereby holding and protecting any elements housed in said inside space.

42. The device of claim 41 further comprising a battery housed within said inside space of said foldable case and electrically connected to said light when said light is in said first position and electrically disconnected from said light when said light is in said second position.

43. The device of claim 42, wherein said battery is adaptable to power selected ones of said functional bookmarks.

44. The device of claim 41 further comprising a pocket within said inside space of said foldable case for holding said functional bookmark.

45. The device of claim 41 further comprising a guide element that extends across an inside edge of said foldable case when said foldable case is in said open position and folds within said inside space of said foldable case.

46. The device of claim 45 further comprising a slider coupled to said guide element, said slider attachable to said functional bookmark so said functional bookmark is moveable across said inside edge of said foldable case when in said open position while being held in a predetermined position relative to said inside edge of said foldable case.

47. The device of claim 41, wherein said functional bookmark is selected from the group consisting of:

an electronic dictionary, an electronic cross-word puzzle dictionary, a voice recorder, a personal digital assistant (PDA), an electronic calculator, an electronic Thesaurus, and a Fresnel lens.

48. The device of claim 46, wherein said functional bookmark is selected from the group consisting of:

an electronic dictionary, an electronic cross-word puzzle dictionary, a voice recorder, a personal digital assistant (PDA), an electronic calculator, an electronic Thesaurus, and a Fresnel lens.

* * * * *